US006140589A

United States Patent [19]

Blackmore

[11] Patent Number: 6,140,589

[45] Date of Patent: Oct. 31, 2000

[54] MULTI-WIRE SZ AND HELICAL STRANDED CONDUCTOR AND METHOD OF FORMING SAME

[75] Inventor: Andrew Blackmore, King, Canada

[73] Assignee: Nextrom, Ltd., Concord, Canada

[21] Appl. No.: 08/832,767

[22] Filed: Apr. 4, 1997

[51] Int. Cl.[7] ..... H01B 5/08

[52] U.S. Cl. ..... 174/128.1

[58] Field of Search ..... 174/128.1, 128.2, 174/106 R, 108, 102 R, 126.1, 126.2; 57/213, 214, 215, 9, 15, 16

[56] References Cited

U.S. PATENT DOCUMENTS

| | | | |
|---|---|---|---|
| 3,339,012 | 8/1967 | Hutchins, Jr. | 174/128.1 |
| 3,676,578 | 7/1972 | Cahill | 174/128.1 |
| 4,372,105 | 2/1983 | Ellis, Jr. | 57/213 X |
| 5,133,121 | 7/1992 | Birbeck et al. | 174/128.1 X |
| 5,260,516 | 11/1993 | Blackmore | 174/128.1 X |
| 5,449,861 | 9/1995 | Fujino et al. | 174/128.1 X |
| 5,745,628 | 4/1998 | Benzel et al. | 385/104 |

*Primary Examiner*—Kristine Kincaid
*Assistant Examiner*—Chau N. Nguyen
*Attorney, Agent, or Firm*—Lackenbach, Siegel, Marzullo, Aronson & Greenspan

[57] ABSTRACT

A multi-wire stranded conductor is formed of a bare wire central core. An intermediate SZ stranded wire is wound on the core, while an outer layer is helically wound on the intermediate SZ wound layer. The intermediate and outer layers assure that the composite conductor maintains a substantially circular cross-section while the helical outer layer also assures the mechanical integrity of the intermediate SZ layer.

17 Claims, 2 Drawing Sheets

MULTI-WIRE SZ AND HELICAL STRANDED CONDUCTOR AND METHOD OF FORMING SAME

BACKGROUND OF THE INVENTION

1. Field of the Invention

This invention generally relates to stranded cable manufacturing and, more particularly, to multi-wire SZ and helical stranded conductors and the method of making the same.

2. Description of the Prior Art

Compressed stranded cable conductors are well known in the art. Examples are disclosed in U.S. Pat. No. 4,473,995, 3,383,704 and 3,444,684. Such cables are preferred over uncompressed cables or compacted cables for several reasons. Compressed conductors typically have a nominal fill factor from about 81% to 84%. Fill factor is defined as the ratio of the total cross-section of the wires in relation to the area of the circle that envelops the strand.

Uncompressed cables require the maximum amount of insulation because the cable diameter is not reduced and because interstitial valleys or grooves between the outer strands are filled with insulation material. Typical fill factors for these conductors are about 76%. On the other hand, compact conductors, although eliminating the above-mentioned drawbacks, might have physical properties that are not desirable for specific applications. Typical fill factors for these constructions range from 91% to 97%.

Multi-wire compressed conductor strands are made in different configurations and by many different methods. Each method and configuration has advantages and disadvantages. One approach is to form the strand with a central wire surrounded by one or more helically layered wires. The strand is made by twisting the wires of each layer about the central wire with a wire twisting machine. A reverse concentric strand is one example of a strand made by this method. Each layer of a reverse concentric strand has a reverse lay in successive layers and an increased length of lay with respect to the preceding layer. In case of a 19-wire conductor strand, two passes might be required through a wire twisting machine to make the strand.

One example of a known strand involves one pass for a 6-wire layer having, for example, a right hand lay over a central wire and a second pass for a 12-wire layer having a left hand lay over the first six wire layer. The strand can also be made in one pass with machines having cages rotating in opposite directions applying both layers at the same time, but the productivity of such machines is very low.

A unilay conductor is a second example of a conductor strand having helically laid layers disposed about the central wire. Each layer of a unilay strand has the same direction of lay and the same length of lay. Because each layer has the same lay length and the same direction, the strand may be made in a single pass. As a result, productivity increases.

Unilay strands are used in a variety of configurations and commonly for sizes up to and including 240 sq. mm.

These strands can be typically manufactured on a Single Twist, Tubular, Rigid, Planetary Machine and, more recently, the Double Twist machine. The economic benefits of the Double Twist machine outweigh the other production processes and is the preferred system for this product. Historically, the limitations of the process has hindered its widespread use for some products. This occurs primarily because of the two stage closing process and the accessibility of the finished product for forming and shaping.

Referring to FIG. 1, one Of the most commonly used unilay conductors is a conductor $S_1$ formed with 19 wires of the same diameter D. In such a strand, the six wires 4 of the inner layer $L_1$ and the twelve wires 6 of the outer layer $L_2$ are twisted about the central core wire 2 in the same way and in a concentric pattern. Normally a hexagonal pattern (dash outline H) is formed, and not the desired round configuration C. This hexagonal configuration presents many basic problems because the circumscribing circle C creates six voids V. These voids are filled with insulation requiring more insulation for a minimum insulation thickness as compared with a true concentric strand.

Experience has also shown that the wires at the corners tend to change position and to back up during extrusion.

As a result of this concern, engineers in the conductor wire industry have been seeking to develop conductor strands which maintain a circular cross-section and increase the uniformity of the conductor section.

One approach is to try to position the outer twelve conductors in such a way as to have each two wires 6*a,* 6*b* at the second layer $L_2$ perched on the surface of one of the six wires 4 of the first layer $L_1$. Such conductor $S_2$, shown in FIG. 2, is sometimes referred to as having a "smooth body" construction which avoids the problem mentioned above in connection with the conductor $S_1$ in FIG. 1.

However, the "smooth body" construction is not stable and cannot be easily achieved on a commercial basis without considerably reducing the lays and, therefore, the productivity of the machine. Furthermore, any variation in wire diameter or tension in the wires can cause the conductor strand to change into the hexagonal configuration shown in FIG. 1 which represents the stable, low energy construction.

Another attempt to solve the problem has been to make a composite strand S3 in accordance with U.S. Pat. No. 4,471,161 and shown in FIG. 3. This last construction has the advantage of being stable, but the disadvantage of requiring wires 6*c,* 6*d* with different diameters $D_1$, $D_2$ in the second layer $L_2$. However, in order to maintain a circular outer cross-section, the diameters $D_1$, $D_2$ which must be selected result in gaps or grooves G between the wires into which insulation can penetrate. A variation on this idea is represented in FIG. 4 where the 7-wire cover (1+6) is compressed, such compression allowing the smaller diameter wires 6*d* to move radially inwardly to a degree which substantially eliminates the tangential gaps in the 12-wire layer $L_2$.

Another solution has been to use a combination of formed or shaped and round elements or wires to assure that the desired fill factor is realized with a stable strand designed minimizing the outer gap area and optimizing the use of the insulating material. One example of such a strand uses a combination of 7 "T" shaped elements with 12 round elements "O" providing a stable strand design. Such constructions are shown in publication No. 211091 published by Ceeco Machinery Manufacturing Limited, at page 537-7. In this construction, the outer 11 elements or wires "O" are in contact with each other thereby minimizing the grooves or spaces and the fill factor is approximately 84%. In such a "O/T/O" configuration, the outside wires abut against the flat surfaces of the inner "T" layer and have no tendency to collapse into the minimal spaces or grooves therein. A modification of the aforementioned strand involves various degrees of compression of the outer round wires with the result that the range of fill factors can be increased from approximately 84 to 91%. Because the inner layer of the 7 conductors is also compacted in the inner layer elements produce a substantially cylindrical outer surface with interstitial grooves minimized or substantially eliminated. While this eliminates the aforementioned problem of the outer layer collapsing into the grooves of the inner layer, such cables have fill factors that are too high for some applications.

A modified concentric compresses unilay stranded conductor design is disclosed in U.S. Pat. No. 5,496,969 issued to Ceeco Machinery Manufacturing Ltd., the assignee of the subject application. The conductor, according to the aforementioned patent, is formed of combinations of compressed wires which nominally have equal diameters. The number or wires selected in any two adjacent layers are not divisible by a common integer with the exception of the integer one. To achieve such construction the conductor in one or more of the layers may need to be formed into sectored cross-sectional configurations. However, to so form the wires they need to be compressed inwardly. The resulting increase in fill factor and decrease in conductor outer diameter, however, has not been acceptable for certain applications in some segments of the market.

SUMMARY OF THE INVENTION

It is an object of the present invention to provide a multi-wire stranded round or sectored conductor which can be manufactured to eliminate the problems mentioned in the prior art while maintaining a high manufacturing efficiency.

It is another object of the present invention to provide a multi-wire stranded round or sectored conductor which has desirable physical characteristics for a wide range of applications and compares favorably with the traditional reverse lay concentric compressed strand conductors.

It is still another object of the present invention to provide a multi-wire stranded round or sectored conductor which maintains a circular cross-section and prevents the undesired movements of wire strands from one layer into intersitices or spaces of adjoining layers which distorts the desired exterior circular cross sectional configuration of the resulting conductor.

It is yet another object of the present invention to provide a multi-wire stranded round or sectored conductor that can be rolled or shaped after the second twist that allows rolling and shaping while maintaining the integrity of the construction without limitation for further processing.

It is an additional object of the present invention to provide a multi-wire stranded conductor which will provide consistent and reliable cross-sectional configurations without the need to use strands or wires of different diameters or formed strands which have other than circular cross sections.

It is further object of the present invention to provide a multi-wire stranded conductor as in the previous objects in which the manufacturing process is facilitated by using the same diameter wires in conjunction with a variety of stranding machines including a double twist machines, single twist machines and drum twisters.

It is still a further objections of the present invention to provide a multi-wire stranded conductor which reliably overcomes the problem of deterioration of some conductors which assume the "hexagonal" cross sectional shape when the same diameter wires are stranded with the same lay length and with the same lay direction.

It is yet a further object of the present invention to provide a multi-wire stranded conductor which will effectively provide a wide lay tolerance for a wide range of conductor diameters.

In order to achieve the above objects, as well as others which will become apparent hereinafter, a multi-wire stranded conductor in accordance with the present invention comprises a bare wire central core. At least one intermediate SZ layer of bare wire is wound on said core. An outer layer of bare wire is helically wound on said at least one SZ wound layer. In this manner, said intermediate and outer layers assure that the composite conductor maintains a substantially circular outer cross section while said helical outer layer assures the mechanical integrity of said at least one SZ intermediate layers. If n layers are wound on a core, at least one intermediate layer 1 to n−1 are SZ wound layers and the outer layer n is helically wound about the intermediate layers . The integer n can be any number typically used in connection with stranded conductors.

The method of forming a multi-wire stranded conductor in accordance with the invention comprises the steps of stranding at least one additional intermediate SZ layer consisting of a plurality of wires about a central core layer consisting of at least one wire. An outer helical layer is stranded about the outermost intermediate SZ layer. In this manner, the intermediate and outer layers assure that the composite conductor maintains a substantially circular outer cross section introduce sector shaping in text while said helical outer layer assures the mechanical integrity of said at least one additional intermediate SZ layers.

BRIEF DESCRIPTION OF THE DRAWINGS

The aforementioned and other features of the present invention will become more apparent from the following discussion and the accompanying drawings, wherein.

DESCRIPTION OF THE PREFERRED EMBODIMENT

Figure 5:
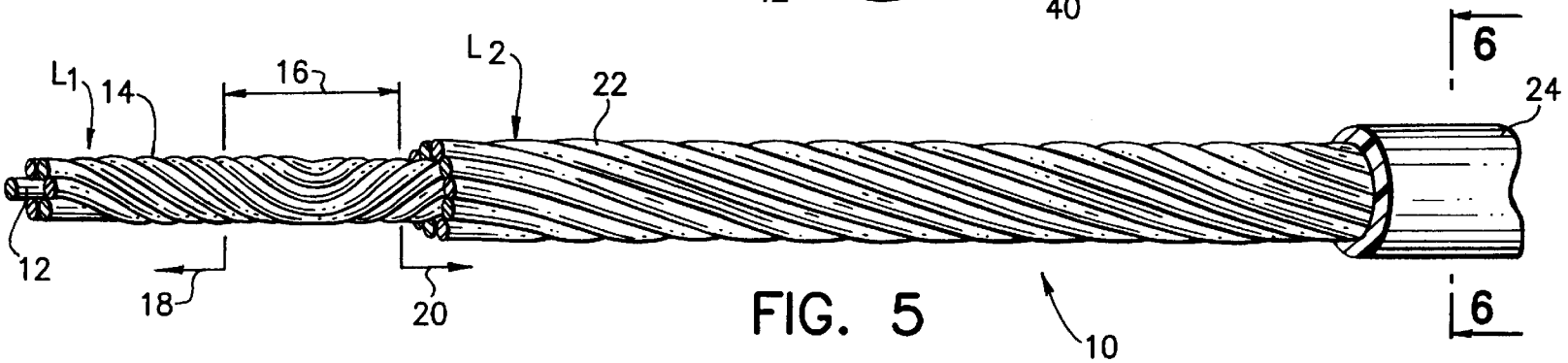
FIG. 5 is a side elevational view, in partial perspective, of a multi-wire stranded conductor in accordance with the present invention, showing successive layers progressively cut away to provide details of the construction.
Figure 6:
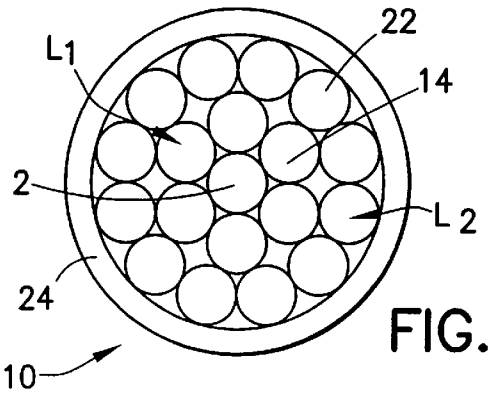
FIG. 6 is a cross sectional view of the conductor shown in FIG. 5, taken along line 6—6.

Referring now, more specifically, to the Figures in which identical or similar parts are designated by the same reference numerals throughout, and first referring to FIGS. 5 and 6, a multi-wire stranded conductor in accordance with the present invention is generally designated by the reference numeral 10.

The conductor 10 in the illustrated embodiment is formed of a single bare wire central core 12. As will be clear to those skilled in the art, and as discussed in U.S. Pat. No. 5,496,969, the central core 12 may also be in the form of a stranded conductor formed of multiple strands but which is treated as a single conductor by the machine line used to make the conductor 10.

At least one intermediate layer $L_1$ is provided which is stranded in an SZ configuration and is likewise formed of bare wire wound on the core 12. Reverse lay or SZ twisting and stranding has become well known in the industry and the specific procedure used to establish the SZ stranded configuration is not critical for purposes of the present invention. Various machinery and techniques used for imparting SZ twisting and stranding are well documented in literature. See, for example, U.S. Pat. Nos. 4,813,223 and 4,288,976. Any suitable apparatus or technique for imparting SZ stranding to the intermediate layers $L_1$ can be used, with different degrees of advantage. In the illustrated embodiment, only one intermediate SZ layer $L_1$ of bare wire is shown wound on the core 12. However, the invention contemplates at least one such SZ layer $L_1$ and numerous such intermediate layers may be provided.

It will be appreciated that for each intermediate SZ layer $L_1$, there are reverses in the lay so that for each lay transition region 16 there is a region 18 onone side which exhibits one lay direction and a region 20, on the other side, which exhibits an opposite lay direction.

An important feature of the present invention is that an outer layer $L_2$ is helically wound on the outer most intermediate SZ wound layer. With this construction, the strands or wires 12, 14 and 22 can all have the same diameter. However, the SZ intermediate layers serve to effectively "fool" the adjacent layers that they have a different lay length and at some instance a different lay direction. Thus, the outer conductors 22, which are being uniformly helically wound with one lay direction, cannot settle into any of the interstices or gaps formed in the intermediate layer $L_1$ but, instead, remain arranged about the contour C which is defined by the outermost points of the conductors 14.

In some instances, the SZ intermediate layers $L_1$ may be slightly deformed or compressed by passage through a suitable die or forming rollers. However, such deformation or forming need not be used in excess in order to maintain the SZ shape and prevent the strands or wires in the SZ layers from separating because the outer layer $L_2$ wound as the outermost SZ layer insures that the composite conductor maintains a substantially circular outer cross section and, at the same time, insures the mechanical integrity of the SZ intermediate layers. The outer layer $L_2$, therefore, serves a number of functions. Firstly, it serves as an outer layer of the conductor 10. However, because it is stranded with a single lay direction, it rests on the outermost intermediate layer, about contour C and, assure a circular outer contour $C_2$. Additionally, the spiral layer $L_2$ serves as a binder that to locks the individual SZ intermediate layers to thereby avoid the need for binders frequently used with SZ cables. As will be clear from FIG. 7, the outer strands of the helical layer $L_2$ tangentially contact each other and are all of the same diameter thereby minimizing the sizes of the intersticial voids V. This minimizes the amount of insulation required for the outer insulating layer 24.

The multi-wire stranded conductor in accordance with the present invention can be made by using large payout packages. As noted, the configuration of the present invention avoids geometry problems. The present invention can be equally used with sectored conductors, where space limitations require more compact conductors.

Figure 1:
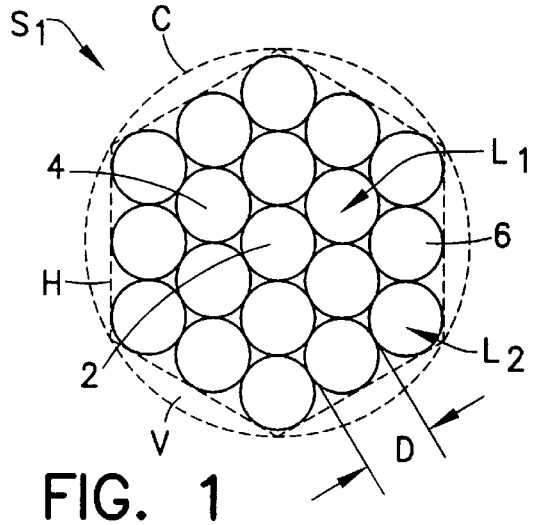
FIG. 1 PRIOR ART
FIG. 1 is a pictorial end view representation of a prior art strand consisting of 19 wires of the same diameter, including a core wire, six wires of an inner layer and twelve wires of an outer layer, which are twisted about the central wire, shown collapsed into a hexagonal pattern as a result of the outer layer wires being received within the interstitial grooves formed by the intermediate layer wires.
Figure 2:
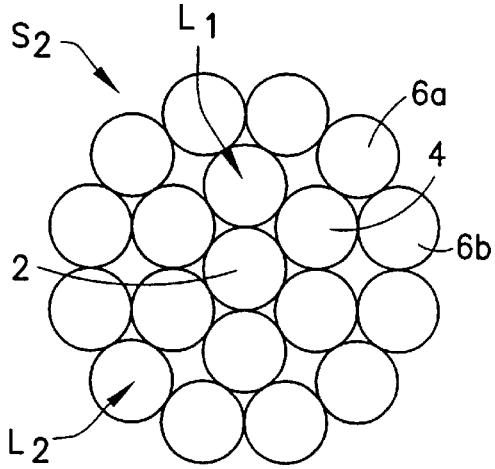
FIG. 2 PRIOR ART
FIG. 2 is similar to FIG. 1, but showing a 19 conductor strand known in the art as a "smooth body" strand, in which pairs of adjacent wires in the outer most layer are perched on the surfaces of the wires of the intermediate layers.
Figure 3:
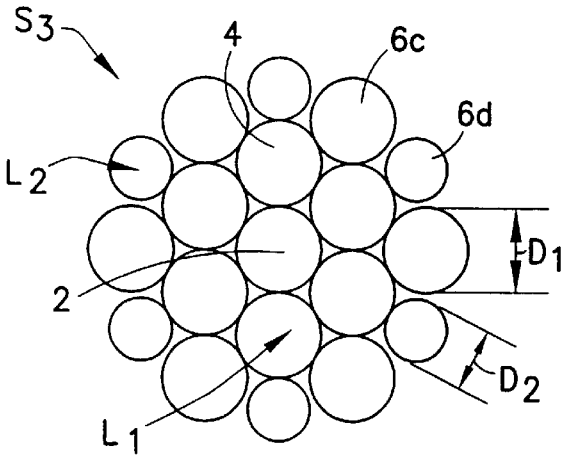
FIG. 3 PRIOR ART
FIG. 3 is similar to FIGS. 1 and 2, but showing a prior art construction of the type disclosed in U.S. Pat. No. 4,471,161, in which the outer layer is formed of some wires having the same diameter as those of the inner layers and which alternate with wires of smaller diameter, in which the large diameter wires of the outer layer are received within the interstitial grooves of the wires of he intermediate layer while the wires of smaller diameter are perched on the radially outermost crests of the intermediate wires.
Figure 4:
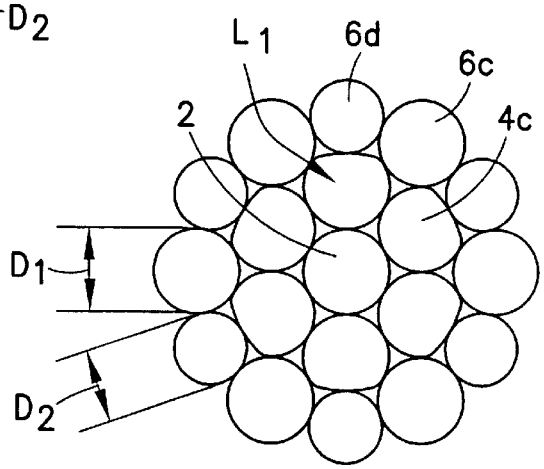
FIG. 4 PRIOR ART
FIG. 4 is similar to FIG. 3 with the exception that the central core wire and the first layer of six wires is compressed, through a die, to reduce the areas of the intermediate layer wires and provide substantially flat surfaces facing radially outwardly to permit the smaller diameter wires in the outer layer to enable the wires in the outer layer to be closer to each other than in the strand shown in FIG. 3.

An important benefit from the use of the present invention is the reduction in the use of tubular and rigid cage stranders while enabling the use of double twist machines. Single twist machines and drum twisters may also be used as can other high speed stranding machinery. For example, consider the production of a conductor as an alternative to, for example, ASTM B786/B787. These specifications cover a construction typically referred to as "combination unilay". In this example, two wire diameters are used to overcome the hexagonal shape which typically results where 19 wires of the same diameter are stranded together with the same lay length and the same lay direction, as exemplified in FIG. 1. The use of the SZ principle applied to the six-wire layer would effectively provide a wide lay tolerance simulating a different lay for the twelve-wire layer. The potential for this process applies equally to circuit sized wires #14-#10 AWG as well as the typical Class B Strand between #8 AWG and 4-0 AWG.

The ability of the present invention to replace rigid frame cages, typically the six and twelve bobbin cages in 37 and/or 61 wire line, is an important benefit. In this example it is only the final wire layer of the strand which need to be continuously spiraled in the traditional sense. Each previously assembled layer would be assembled using the SZ principal. An alternative to the above is the use of this technology operating with a drum twister or single twist machine. In this instance, the need for wire wound on reels would be eliminated and the final spiral performed using the rotation of the drum twister or single twist machine. The preferred package for this strand would be the large stem or coil packages manufactured using the 36" or 42" coilers.

Figure 7:
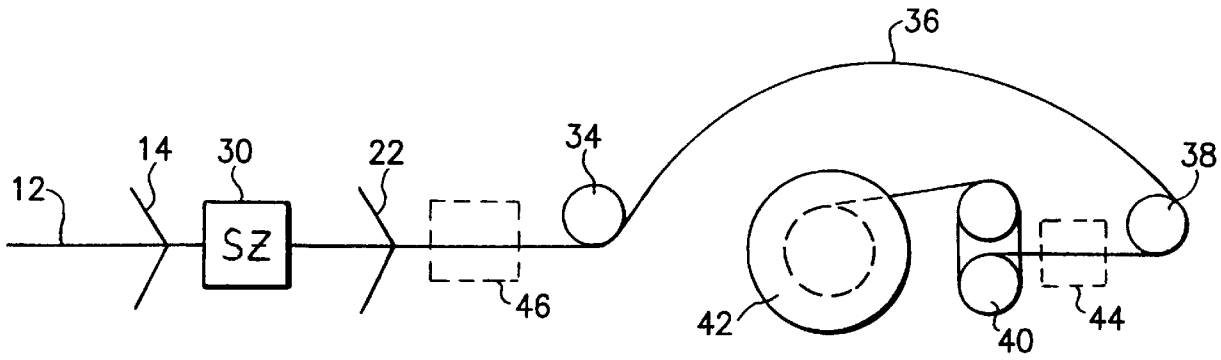
FIG. 7 is a schematic representation of a line including a double twist machine for producing the strand construction shown in FIGS. 5 and 6.

In referring to FIG. 7, a schematic of a typical manufacturing line is illustrated for the manufacture of the cable shown in FIGS. 5 & 6. The core 12, as suggested, can consist of a single wire or a stranded composite wire which is introduced along the axis of the line. Suitable stem or coil packages (not shown) are provided and directed to bring the wires 14 of the first layer $L_1$ to a closing die. A suitable SZ oscillator or unit 30 is introduced just downstream of the point where the intermediate layer wires 14 are introduced and these wires are SZ stranded about the core 12. Similarly, the outer strands or wires 22 forming the outer layer $L_2$ are introduced downstream of the SZ unit 30 through an appropriate closing die so as to position these wires about the outer layer $L_1$. The strands are arranged in the desired orientations and are advanced to the double twist machine 32 which includes initial input pulley 34, bow 36 and, outlet or final pulley 38. Once inside the double twist machine and after having been twisted to the extent desired, a take up 40 is used to draw the wires which are then wound onto a spool or bobbin 42. When the stranded conductors are to be sectored, there is advantageously provided a sector rolling area 44 between the output or final pulley 38 and the take-up 40, the takeup 40 drawing the wires through the sector rolling area 44 for imparting the desired sector configurations.

As indicated, because the individual conductors need not be excessively compresses or compacted in order to prevent the separation of the individual strands or wires of the SZ layers, the fill factors can be reduced as compared to the fill factors associated with the conductors disclosed in U.S. Pat. No. 5,496,969. Thus, fill factors of the composite conductor may be no greater than 90% and may be reduced to no greater than 85%. For many applications, the fill factor is preferably between 76–82%. Such low fill factors provide the added benefits of maintaining the outer diameters of the composite cables slightly larger than those achievable with compacted or compressed conductors. This may be important for applications requiring terminations of the conductors with electrical connectors which are designed to mate with conductors having predetermined diameters. Additionally, by reducing the fill factors, the cables become more flexible which is an advantage for some applications. It will be appreciated, therefore, that the construction of the conductors in accordance with the present invention provide significant flexibility and efficiency of production. Because the resulting conductor is highly geometrically stable and maintains the desired circular cross section at all times, independently of the amount of compression or compaction, the degree of compression or compaction may be selected to satisfy other requirements for any given application, such as flexibility, outer diameter, fill factor, etc. Irrespective of the degree of compaction or compression selected, however, the cable will maintain its circular outer shape and the amount of insulation applied to the cable will always be minimized.

While the preferred embodiment illustrates the use of circular strands to produce the conductor 10, this application is equally applicable to the production of conductors with sectored strands. Sectors are similar to pie shapes with different angles. Sectored strand can be any angle, but the two most common are the 90 degree and 120 degree sectors. Others include 60 degree, 72 degree, 100 degree, and 180 degree sectors among others.

The known parameters that are necessary to manufacture sectored strand are the same as the round strand with the exception that the round strand is rolled through one set or a series of sets of rollers to produce the required profile. The current practice is to produce a O/T/O construction and then roll the round shape into the sectored shape immediately prior to the capstan. The use of the O/SZ/O construction combined with the same sector rolling process simulates the same constructions that are currently used in the industry and represents an ideal solution for segments of the industry that wish to use the cost effective Double Twist process without appearing to change the construction of the established product.

Thus, the introduction of the SZ strand layer provides the option to simulate a reverse concentric construction with a unilay buildup. This allows the same geometry of a reverse concentric strand constructions with, for example, the cost effective Double Twist manufacturing process. It further introduces the potential to manufacture multi-layer conductor strand in tandem with extrusion systems. If an extruder 46 were to be placed in the line shown in FIG. 7, it could be positioned between the final closing point (at 22) and takeup of the insulated product which would, preferably, be a single twist or drum machine or the like other than a double twist machine.

While this invention has been understood in detail with particular reference to the preferred embodiments thereof, it will be understood that variations and modifications can be achieved within the spirit and scope of the invention as described herein and as defined in the appended claims.

What is claimed is:

1. A multi-wire stranded conductor comprising a bare wire central core; at least one intermediate SZ layer of bare wire wound on said core; and an outer layer of bare wire helically wound on said at least one SZ wound layer, whereby said intermediate and outer layers assure that a composite conductor maintains a substantially circular outer cross-section while said helical outer layer assures the mechanical integrity of said at least one SZ intermediate layer.

2. A multi-wire stranded conductor as defined in claim 1 wherein said central core comprises a single wire strand.

3. A multi-wire stranded conductor as defined in claim 1, wherein one intermediate SZ layer is provided.

4. A multi-wire stranded conductor as defined in claim 1, wherein said core, intermediate and outer layers are all formed of wire strands having circular cross sections.

5. A multi-wire stranded conductor as defined in claim 1, wherein at least one of said layers is formed of wire strands having sectored cross sections.

6. A multi-wire stranded conductor as defined in claim 1, wherein a fill factor of a composite conductor is no greater than 90%.

7. A multi-wire stranded conductor as defined in claim 6, wherein the fill factor is no greater than 85%.

8. A multi-wire stranded conductor as defined in claim 7, wherein the fill factor is selected within the range of 76–82%.

9. A multi-stranded conductor comprising a central core; and n layers wound on said core, at least one intermediate layer 1 to n−1 being SZ wound layers and a radially outermost layer n being helically wound about said intermediate layers, said at least one intermediate and outer layer assuring that a composite conductor maintains a substantially circular outer cross-section while said helical outer layer assures the mechanical integrity of said at least one SZ intermediate layer and wherein n is an integer >1.

10. A multi-wire stranded conductor as defined in claim 9, wherein n=2.

11. A multi-wire stranded conductor as defined in claim 9, wherein said core, intermediate and outer layers are all formed of wire strands having circular cross sections.

12. A multi-wire stranded conductor as defined in claim 9, wherein at least one of said layers is formed of wire strands having sectored cross sections.

13. A multi-wire stranded conductor as defined in claim 12, wherein a fill factor is selected within the range of 76–82%.

14. A multi-wire stranded conductor as defined in claim 9, wherein the fill factor of the composite conductor is no greater than 90%.

15. A multi-wire stranded conductor comprising a bare wire central core; at least one intermediate SZ layer of bare wire wound on said core; and an outer layer of bare wire helically wound on said at least one SZ wound layer, whereby said intermediate and outer layers assure that a composite conductor maintains a substantially circular outer cross-section while said helical outer layer assures the mechanical integrity of said at least one SZ intermediate layer, wherein said core, intermediate and outer layers are all formed of wire strands having circular cross sections, and wherein all said strands have the same diameter.

16. A multi-stranded conductor comprising a central core; and n layers wound on said core, at least one intermediate layer 1 to n−1 being SZ wound layers and a radially outermost layer n being helically wound about said intermediate layers, said at least one intermediate and outer layer assuring that a composite conductor maintains a substantially circular outer cross-section while said helical outer layer assures the mechanical integrity of said at least one SZ intermediate layer, wherein said core, intermediate and outer layers are all formed of wire strands having circular cross sections, and wherein all said strands have the same diameter.

17. A multi-wire stranded conductor as defined in claim 13, wherein a fill factor is no greater than 85%.

* * * * *